US010005049B2

(12) United States Patent
Lee

(10) Patent No.: US 10,005,049 B2
(45) Date of Patent: Jun. 26, 2018

(54) ONE-PASS TYPE DISPERSING AND EMULSIFYING APPARATUS

(71) Applicant: KOREA STANDARD COMPANY, Suwon-si, Gyeonggi-do (KR)

(72) Inventor: Beom-seop Lee, Suwon-si (KR)

(73) Assignee: KOREA STANDARD COMPANY, Suwon-si, Gyeonggi-do (KR)

( * ) Notice: Subject to any disclaimer, the term of this patent is extended or adjusted under 35 U.S.C. 154(b) by 204 days.

(21) Appl. No.: 14/377,505

(22) PCT Filed: Nov. 13, 2012

(86) PCT No.: PCT/KR2012/009542
§ 371 (c)(1),
(2) Date: Aug. 7, 2014

(87) PCT Pub. No.: WO2013/141461
PCT Pub. Date: Sep. 26, 2013

(65) Prior Publication Data

US 2015/0009777 A1 Jan. 8, 2015

(30) Foreign Application Priority Data

Mar. 23, 2012 (KR) ..... 10-2012-0029911

(51) Int. Cl.
*B01F 7/16* (2006.01)
*B01F 3/08* (2006.01)
(Continued)

(52) U.S. Cl.
CPC ..... *B01F 7/1675* (2013.01); *B01F 3/08* (2013.01); *B01F 3/0807* (2013.01);
(Continued)

(58) Field of Classification Search
CPC .. B01F 7/00808; B01F 7/1635; B01F 7/1675; B02C 17/163
(Continued)

(56) References Cited

U.S. PATENT DOCUMENTS 2,115,123 A * 4/1938 Russell ..... B01F 7/00808 241/104

FOREIGN PATENT DOCUMENTS

KR 10-0375296 B1 3/2003
KR 10-0499199 B1 7/2005
(Continued)

*Primary Examiner* — Tony G Soohoo
*Assistant Examiner* — Elizabeth Insler
(74) *Attorney, Agent, or Firm* — Novick, Kim & Lee, PLLC; Jae Youn Kim

(57) ABSTRACT

Provided is an one-pass type dispersing and emulsifying apparatus, including: a chamber, at both sides of which an inlet for inputting a liquid and an outlet for discharging the liquid is arranged to provide a moving path for the liquid therein; a shaft rotatably arranged inside the chamber; a motor arranged for rotating the shaft; a rotation impeller fixed to the shaft as a plurality at a predetermined interval along a length direction and arranged on the moving path for the liquid, wherein at each rotation impeller, a first blade extended toward the inner circumferential surface of a fixing impeller is formed at a predetermined interval as a plurality along the length direction of the shaft; and a fixing impeller provided on the inner surface of the chamber as a plurality along the length direction of the shaft to be disposed around the rotation impeller.

4 Claims, 4 Drawing Sheets

(51) Int. Cl.
*B01F 7/00* (2006.01)
*B01F 13/00* (2006.01)
*B01F 3/10* (2006.01)

(52) U.S. Cl.
CPC ..... *B01F 3/0853* (2013.01); *B01F 7/00808* (2013.01); *B01F 13/0032* (2013.01); *B01F 2003/105* (2013.01)

(58) Field of Classification Search
USPC ..... 366/302–307
See application file for complete search history.

(56) References Cited

FOREIGN PATENT DOCUMENTS

| | | |
|---|---|---|
| KR | 10-0517025 B1 | 9/2005 |
| KR | 10-0570330 B1 | 4/2006 |

* cited by examiner

ONE-PASS TYPE DISPERSING AND EMULSIFYING APPARATUS

BACKGROUND OF THE INVENTION

Technical Field

The present invention relates to an one-pass type dispersing and emulsifying apparatus, and more particularly, to an one-pass type dispersing and emulsifying apparatus, capable of treating liquid of a low viscosity and also liquid of high viscosity having a low liquidity with an excellent dispersing and emulsifying efficiency, and controlling the flow amount of liquid required to be treated as desired.

Background Art

In general, minuteness and uniformity in dispersion and emulsion of fine particles are important to an extent to affect quality of a finished-product in a field of a basic-material industry including food groceries, cosmetics, ink, paint, adhesive, coatings, precise chemicals and new nano material, and high-tech electronic material. For this purpose, dispersing and emulsifying devices in various types have been developed and used.

In the dispersing and emulsifying device, a shearing force is applied to liquid to cause dispersion and emulsifying therein wherein in the case of a high pressure type homogenizer, pressure is converted into jet stream to be collided with a wall or reversed so that kinetic energy of the jet stream is converted into shearing energy between liquids, causing the dispersion and emulsifying.

In a conventional dispersion and emulsifying device of the homogenizer type, pressure difference and velocity difference are produced between liquids since the jet stream is converted and used so that air dissolved in the liquid or air remained in the system produces bubbles thereby to produce coarse and large particles. Further, since desired dispersion or emulsifying effects are not obtained through one-pass of the liquid, the liquid needs to be circulated several times, thereby spending much time for dispersion and emulsifying and decreasing efficiency thereof.

Further, a conventional dispersion and emulsifying device of the homogenizer type uses a self-suction type, that is, the type is that the liquid is inhaled and discharged due to the pressure difference resulting from the rotation of the liquid, wherein the self-suction type is applied only to material of low viscosity having liquidity since the liquid needs to be movable, and thus it is difficult for the self-suction type to be applied in emulsifying the material of high viscosity. Meanwhile, cavitation is caused under the self-suction type and thus it is difficult to control the flow amount of the liquid to be dispersed or emulsified.

DISCLOSURE

Technical Problem

The present invention has been proposed to solve the above problems and one object of the present invention is to provide an one-pass type dispersing and emulsifying apparatus, capable of treating liquid of a low viscosity and also liquid of high viscosity having a low liquidity to have an excellent dispersing and emulsifying efficiency, and controlling the flow amount of liquid required to be treated as desired.

Other objects of the present invention will be understood easily through the below descriptions of preferred embodiments.

Technical Solution

To solve the prior-art problems, it is an object of the present invention to provide an one-pass type dispersing and emulsifying apparatus, capable of treating liquid of a low viscosity and also liquid of high viscosity having a low liquidity with an excellent dispersing and emulsifying efficiency, and controlling the flow amount of liquid required to be treated as desired.

An one-pass type dispersing and emulsifying apparatus according the present invention may include: a chamber, at both sides of which an inlet for inputting a liquid and an outlet for discharging the liquid is arranged to provide a moving path for the liquid therein; a shaft rotatably arranged inside the chamber; a motor arranged for rotating the shaft; a rotation impeller fixed to the shaft as a plurality at a predetermined interval along a length direction and arranged on the moving path for the liquid, and in each rotation impeller, a first blade extended toward the inner circumferential surface of a fixing impeller is formed at a predetermined interval as a plurality along the length direction of the shaft; and a fixing impeller that is provided on the inner surface of the chamber as a plurality along the length direction of the shaft to be disposed around the rotation impeller, wherein at each fixing impeller a second blade extended toward the center of the fixing impeller and formed at a predetermined interval as a plurality along a circumferential direction is arranged between the rotation impellers, and wherein a shearing force is produced for the liquid passing through the chamber by the relative rotation with the second blade when the first blade rotates.

The one-pass type dispersing and emulsifying apparatus may further include a frame fixed to a shaft cover such that the chamber is directed downward and fixed to a fixing bracket such that the motor is arranged on the top of the shaft cover so that a coupling for connecting the shaft of the motor and the shaft protruding to top of the chamber is arranged within the shaft cover.

The shaft may be arranged vertically in the chamber so that the rotation impellers are arranged upwardly and downwardly, the fixing impellers are fixed to be stacked up and downwardly on an inner circumferential surface, the inlet is formed at a bottom, and the outlet is formed at the top side of the chamber.

A stacking space for stacking the fixing impeller may be formed in the chamber and a cover for opening/closing the stacking space is connected to a side of the stacking space using a bolt so as to support the fixing impeller.

The plurality of rotation impellers may be sliding-connected to a side of the shaft to be stacked as multi-steps while maintaining a predetermined interval by a spacer.

A cap for preventing the rotation impeller from being deviated may be fixed to one remote end of the shaft using bolt.

The second blade may be formed as a plurality in the fixing impeller along the inner circumferential surface of a ring member having a ring shape to be inserted to an inner surface of the chamber.

A step may be formed between the second blade and the inner circumferential surface of the ring member such that the remote end of the first blade overlapped on the second blade is to be adjacent to the inner circumferential surface.

Advantageous Effects

The one-pass type dispersing and emulsifying apparatus of the present invention has the following effects.

Firstly, the liquid can be dispersed or emulsified as desired solely by passing one time along the path thanks to excellent intensive capability and efficiency.

Secondly, since a high speed dispersion is performed intensively with respect to the liquid pushed by a pump arranged on the front of chamber, not by the self-suction, a liquid of low viscosity and also a liquid of high viscosity having low liquidity can be treated.

Thirdly, the cavitation can be prevented to control the flow amount of the liquid to be treated as desired.

Fourth, the impellers can be replaced variably and used, or added or removed and thus the one-pass type dispersing and emulsifying apparatus of the present invention can be used multi-functionally.

Fifth, it can rotate at a high speed while maintaining precise clearance to perform a defoamation function through a treatment of liquid having bubbles, and if necessary, bubbles can be input to the liquid by injecting air thereto.

Sixth, multi stages, for example, 8 stages or more dispersion or emulsifying of the liquid can be performed and thus precise dispersion of multi stages is possible in accordance with the use and usage condition of the liquid, and the one-pass type dispersing and emulsifying apparatus of the present invention can have effects to establish several devices of a conventional process, thereby to save cost and time required to maintain it.

BRIEF DESCRIPTION OF THE DRAWINGS

The above objects, other features and advantages of the present invention will become more apparent by describing the preferred embodiments thereof with reference to the accompanying drawings, in which.

PREFERRED EMBODIMENTS OF THE INVENTION

Figure 1:
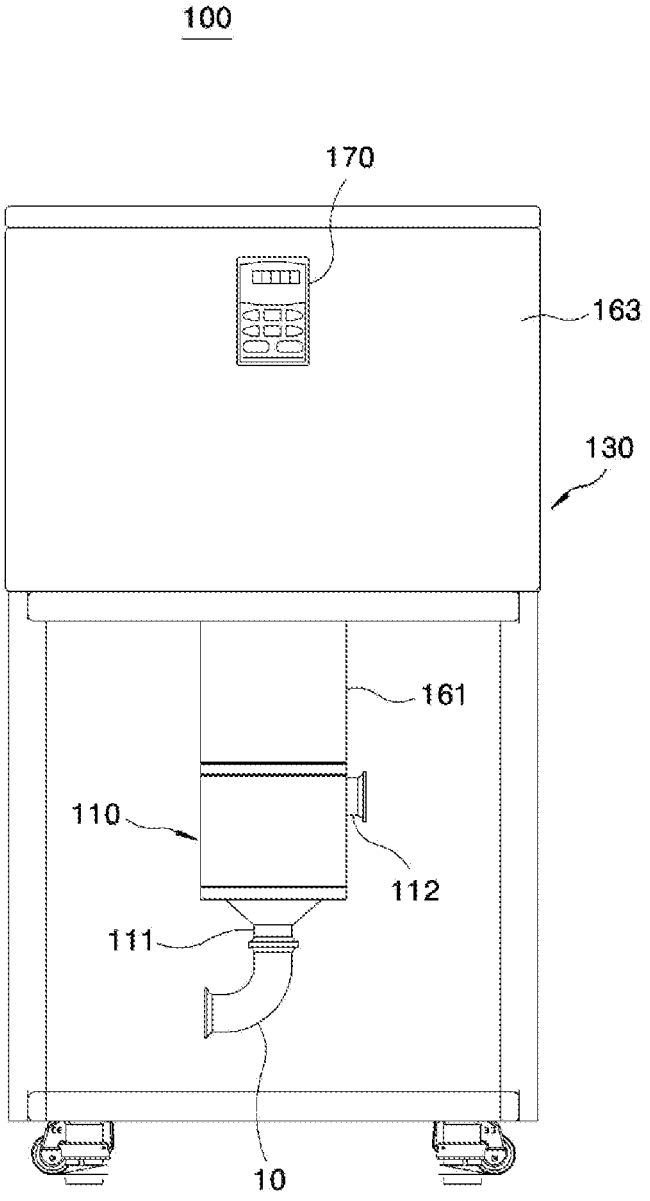
FIG. 1 is a front view illustrating a one-pass type dispersing and emulsifying apparatus according to an embodiment of the present invention.

The embodiments according to a concept of the present invention may be changed variously and have various types and thus the special embodiments will be illustrated by the drawings and described in the specification. However, the embodiments according to a concept of the present invention are not limited to the specifically disclosed types and thus it should be understood that it includes all modifications and equivalents or replacements included within a spirit and a scope of the present invention.

Hereinafter, reference numerals will now be made in detail to various embodiments of the present invention, examples of which are illustrated in the accompanying drawings and described below. In the drawings, the same reference numerals refer to the same components.

Figure 2:
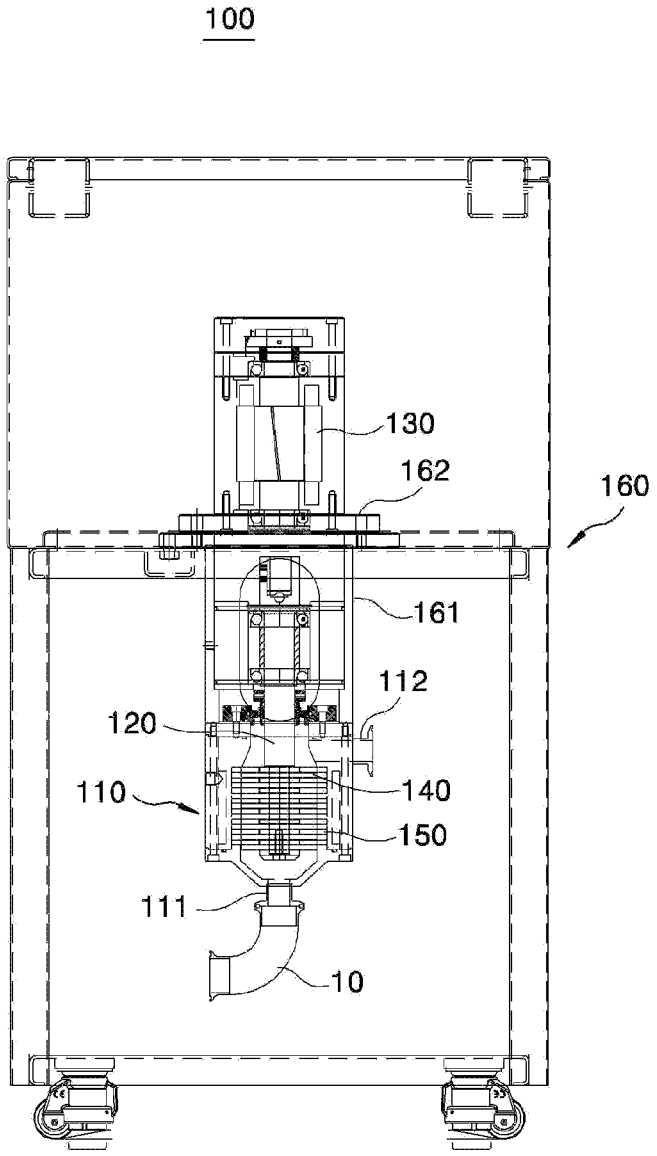
FIG. 2 is a front cross-sectional view illustrating a one-pass type dispersing and emulsifying apparatus according to an embodiment of the present invention.

FIG. 1 is a front view illustrating a one-pass type dispersing and emulsifying apparatus according to an embodiment of the present invention and FIG. 2 is a front cross-sectional view illustrating a one-pass type dispersing and emulsifying apparatus according to an embodiment of the present invention.

As shown in FIGS. 1 and 2, a one-pass type dispersing and emulsifying apparatus 100 according to an embodiment of the present invention may include: a chamber 110; a shaft 120; a motor 130; a rotation impeller 140; and a fixing impeller 150, in which the liquid to be supplied is dispersed or emulsified and then discharged. Here, the liquid may include sauce or mayonnaise, cosmetic cream, toothpaste, bonding agent, pigment of ink or paint, film coatings, various viscosity increasing agent, foam agent, secondary cell solution, chemical solution for treating waste from semiconductor wafer, environment-friendly recycling solution and the like. Here, in the case of the environment-friendly recycling solution, fine particles are produced physically therein for an easy chemical environment-treatment by the one-pass type dispersing and emulsifying apparatus 100 of the present invention.

Meanwhile, the one-pass type dispersing and emulsifying apparatus 100 according to an embodiment of the present invention may further include a frame 160 for installing the chamber 110 and the motor 130 and the like, wherein the frame 160 is fixed to a shaft cover 161 such that the chamber 110 is directed downward, and is fixed to a fixing bracket 162 such that the motor 130 is arranged on the top of the shaft cover 161 so that a coupling 132 (shown in FIG. 3) for connecting the shaft 131 of the motor 130 and the shaft 120 protruding to the top of the chamber 110 is arranged within the shaft cover 161. Further, the motor 130 and other components may be covered with a protection cover 163.

The chamber 110 is provided with an inlet 111 for inputting liquid and an outlet 112 for discharging the liquid at both sides thereof, thereby to provide a moving path for the liquid therein.

Figure 3:
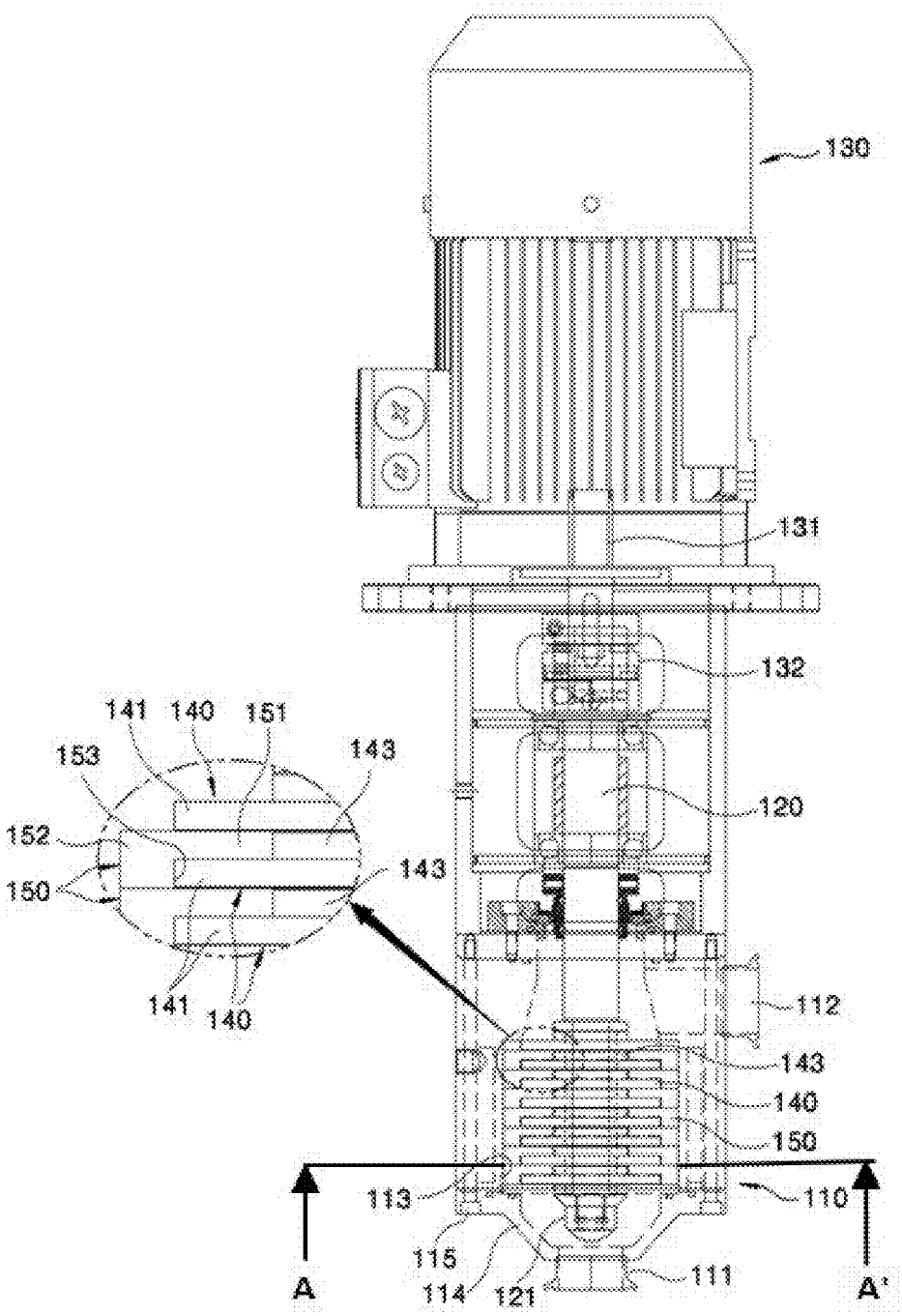
FIG. 3 is a front cross-sectional view illustrating main parts of a one-pass type dispersing and emulsifying apparatus according to an embodiment of the present invention.

As shown in FIG. 3, the shaft 120 is arranged vertically in the chamber 110 as described in the present embodiment so that the rotation impellers 140 may be arranged upwardly and downwardly, the fixing impellers 150 may be stacked upwardly and downwardly on an inner circumferential surface, the inlet 111 is formed at a bottom, and the outlet 112 may be formed at the top side of the chamber. Here, an input line 10 for inputting the liquid to be dispersed and emulsified may be connected to the inlet 111 and an discharging line (not shown) for supplying the liquid that has been dispersed and emulsified within the chamber 110 to an storage tank outside may be connected to the outlet 112. Additionally, the liquid is supplied to the inlet 111 through the input line 10 with a pumping force by a pump for liquid, which is arranged outside, so that the discharging pressure through the outlet 112 may be maintained.

Meanwhile, a stacking space 113 for stacking the fixing impeller 150, which will be described later, may be formed in the chamber 110, and a cover 114 for opening/closing the stacking space 113 may be connected to a side of the stacking space 113, that is, a bottom thereof, using a bolt 115 so as to support the fixing impeller 150. Accordingly, the fixing impeller 150 may be replaced through the detachment of the cover 114.

The shaft 120 is rotatably installed inside the chamber 110, wherein the shaft 120, as in the present embodiment, may be installed to pass through the chamber 110 to be connected to the shaft 131 of the motor 130 through the coupling 132. Here, the shaft 120 may be installed in the chamber 110 or the frame 160 through bearing to rotate smoothly with respect to the chamber 110 and an O-ring may be arranged on a connection portion with the chamber 110 so as to maintain air-tight of the chamber 110.

The motor 130 may be arranged on the frame 160 so as to rotate the shaft 120 and operated by the operation of a control panel 170 (shown in FIG. 1) that is arranged on the frame 160 or an external part thereof to rotate the shaft 120. Here, the rotation speed of the motor may be controlled by the operation of the control panel 170 (shown in FIG. 1).

Figure 4:
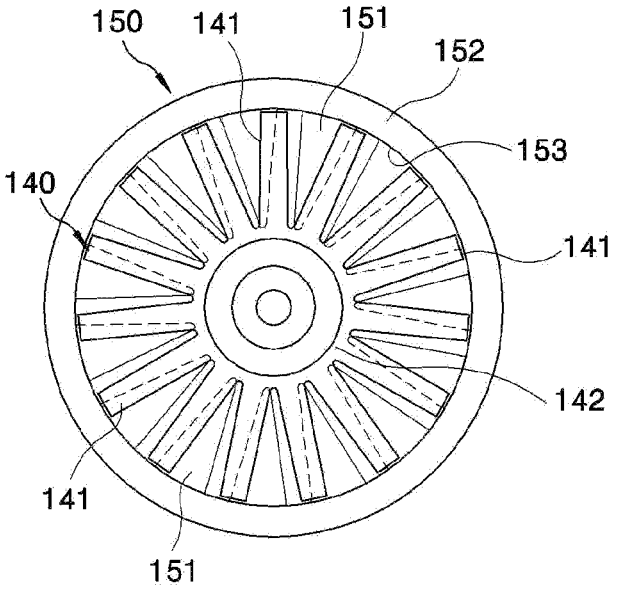
FIG. 4 is a cross-sectional view illustrating a one-pass type dispersing and emulsifying apparatus, taken along line A-A' of FIG. 3.

A plurality of the rotation impellers 140 are fixed to the shaft 120 along a length direction at a predetermined interval to be arranged on the moving path for liquid, as shown in FIG. 4, a plurality of first blades 141 that are extended toward an inner circumferential surface of the fixing impeller 150 are formed along a circumferential direction at a predetermined interval in the respective rotation impeller 140.

The plurality of rotation impellers 140 are sliding-connected to a side of the shaft 120, that is, the bottom of the shaft, to rotate together with the shaft 120 and further be stacked as multi-steps while maintaining a predetermined interval by a spacer 143. Here, the spacer 143 may be provided separately from the rotation impeller or may be formed integrally with the rotation impeller 140.

The rotation impeller 140 may have a connecting portion 142 (shown in FIG. 4) on an outer circumferential surface of which a plurality of first blades 141 are formed for the sliding-connection with the shaft 120 wherein a hole of the connection portion 142, into which the shaft 120 is inserted, may have a sectional shape for the shaft 120 not to be loosened from the hole, or the shaft 120 may be fixed to the rotation impeller with a pin, or the rotation impeller may be fixed to the shaft 120 using a separate ring bracket. Here, a cap 121 for preventing the rotation impeller 140 from being deviated may be connected to one end, for example, the bottom of the shaft 120 using various ways such as screw-connection.

The fixing impeller 150 may be provided as a plurality along the length direction of the shaft 120 on an inner surface of the chamber 110 to be disposed around the rotation impeller 140, and as shown in FIG. 4, a plurality of second blades 151 that are extended toward the center of the fixing impeller 150 and arranged along a circumferential direction at a predetermined interval between the rotation impellers 140. Here, a shearing force is produced to a liquid passing through the chamber 110 by the relative rotation with the second blade 151 when the first blade 141 rotates.

The plurality of second blades 151 may be formed in the fixing impeller 150 along the inner circumferential surface of a ring member 152 having a ring shape to be inserted to the inner surface of the chamber 110, the second blade 151 may be spaced at an interval of 2 mm or so from the first blade 141, and a step 153 may be formed between the second blade 151 and the inner circumferential surface of the ring member such that the remote end of the first blade 141 to be overlapped on the second blade 151 is to be adjacent to the inner circumferential surface. Accordingly, the shearing force may be produced increasingly to the liquid between the fixing impeller 150 and the rotation impeller 140.

Hereinafter, the operation of the one-pass type dispersing and emulsifying apparatus according to the present invention will be described.

When a liquid is input into the inlet 111 using pumping force of a pump that is arranged on the front of the inlet 111 and driven by a motor 130, the liquid is dispersed or emulsified by receiving a shearing force by the first blade 141 of the rotation impeller 140 that are rotating while the liquid input into the inlet 111 passes through a space formed by the intervals between the second blades 151 as multi stages. Likewise, the liquid pasting through the first blade 141 and the second blade 151 is dispersed or emulsified and further reduced in particle intensively and high efficiently by the relative rotation with the first blade 141 and the second blade 151. That is, the liquid is sufficiently dispersed or emulsified solely by passing one time along the path formed at an inner part of the chamber 110. The dispersed or emulsified liquid is discharged toward the outlet 112.

According to the one-pass type dispersing and emulsifying apparatus of the present invention, since a high speed dispersion is intensively performed with respect to the liquid supplied by a pump that is arranged on the front of chamber, not by the self-suction, a liquid of low viscosity and also a liquid of high viscosity having low liquidity can be treated and further the cavitation can be prevented to control the flow amount of the liquid to be treated as desired. Further, the impellers 140, 150 can be variably replaced and used, or added or removed and thus the one-pass type dispersing and emulsifying apparatus of the present invention can be used multi-functionally.

INDUSTRIAL APPLICABILITY

Further, according to the one-pass type dispersing and emulsifying apparatus of the present invention, it can rotate at a high speed while maintaining precise clearance to perform a defoamation function through a treatment of liquid having bubbles, and if necessary, bubbles can be input to the liquid by injecting air thereto. Additionally, multi stages, for example, 8 stages or more dispersion or emulsifying of the liquid can be performed by stacking the rotation impeller 140 and the fixing impeller 150 and thus precise dispersion of multi stages is possible in accordance with the use and usage condition of the liquid.

Meanwhile, the one-pass type dispersing and emulsifying apparatus of the present invention can have effects to establish several devices of a conventional process thereby to save cost time required to maintain it.

While the present invention has been described in connection with the specific embodiments illustrated in the drawings, they are merely illustrative, and the invention is not limited to these embodiments. It is to be understood that various equivalent modifications and variations of the embodiments can be made by a person having an ordinary skill in the art without departing from the spirit and scope of the present invention.

What is claimed is:

1. An one-pass type dispersing and emulsifying apparatus, comprising:

a chamber, at both sides of which an inlet for inputting a liquid and an outlet for discharging the liquid are respectively arranged to provide a moving path for the liquid therein;

a first shaft rotatably arranged inside the chamber;

a motor arranged for rotating the first shaft;

a plurality of rotation impellers fixed to the first shaft at a predetermined interval along a length direction of the first shaft and arranged in the moving path for the liquid;

a plurality of fixing impellers that is provided on an inner circumferential surface of the chamber along the length direction of the first shaft to be disposed around the plurality of rotation impellers; and a plurality of spacers that are each provided separately from the plurality of rotation impellers and disposed between the respective plurality of rotation impellers, wherein each of the plurality of rotation impellers has a plurality of first blades extended toward the inner circumferential surface of the chamber and is disposed at a predetermined interval along a circumferential direction of the respective rotation impeller, wherein each fixing impeller has a plurality of second blades extended toward a center of the plurality of rotation impellers, is formed at a predetermined interval along a circumferential direction thereof and is arranged between the plurality of rotation impellers in substantial contact with the first blades, wherein a shearing force is produced for the liquid passing through the chamber by a relative rotation between the respective first blade and the respective second blade when the respective first blade rotates, wherein the first shaft is arranged vertically in the chamber, the plurality of rotation impellers are arranged upwardly and downwardly, the plurality of fixing impellers are fixed to be stacked up and downwardly on the inner circumferential surface of the chamber, the inlet is formed at a bottom of the chamber, and the outlet is formed at a top side of the chamber, wherein the plurality of second blades are formed along an inner circumferential surface of a ring member having a ring shape to be inserted to the inner circumferential surface of the chamber, wherein a step is formed between the respective second blade and the inner circumferential surface of the ring member such that a remote end of the respective first blade overlapped on the respective second blade is to be substantially in contact with the inner circumferential surface of the ring member, wherein the plurality of rotation impellers are sliding-connected to a side of the first shaft to be stacked as multi-steps while maintaining a predetermined interval by the respective plurality of spacers, wherein an upper and a lower surfaces of each spacer are substantially in contact with two adjacent first blades of the plurality of rotation impellers, and wherein an end of each spacer is substantially in contact with an end of the respective second blade.

2. The one-pass type dispersing and emulsifying apparatus of claim 1, further comprising a frame fixed to a shaft cover such that the chamber is directed downward and fixed to a fixing bracket, wherein the motor is arranged on a top of the shaft cover so that a coupling for connecting a second shaft of the motor and the first shaft protruding to a top of the chamber is arranged within the shaft cover.

3. The one-pass type dispersing and emulsifying apparatus of claim 1, wherein a stacking space for stacking the plurality of fixing impellers is formed in the chamber and a cover for opening/closing the stacking space is connected to a side of the stacking space using a bolt so as to support the plurality of fixing impellers.

4. The one-pass type dispersing and emulsifying apparatus of claim 1, wherein a cap for preventing the plurality of rotation impellers from being deviated is fixed to one remote end of the first shaft using a bolt.

* * * * *